US005349832A

United States Patent [19]

Johnson et al.

[11] Patent Number: 5,349,832

[45] Date of Patent: Sep. 27, 1994

[54] MULLION BAR ASSEMBLY WITH ENHANCED HEAT TRANSFER BARRIER CHARACTERISTICS

[75] Inventors: Thomas M. Johnson; John C. Ellingwood, both of Galesburg, Ill.

[73] Assignee: Maytag Corporation, Newton, Iowa

[21] Appl. No.: 61,004

[22] Filed: May 14, 1993

[51] Int. Cl.[5] ..... F25D 11/02

[52] U.S. Cl. ..... 62/447; 312/407; 62/272

[58] Field of Search ..... 62/77, 80, 272, 298, 62/441, 447; 312/407

[56] References Cited

U.S. PATENT DOCUMENTS

| | | | |
|---|---|---|---|
| 1,992,011 | 2/1935 | Knight | 62/89 |
| 2,446,336 | 8/1948 | Mark et al. | 20/69 |
| 2,460,469 | 2/1949 | Rifkin et al. | 62/89 |
| 2,537,314 | 1/1951 | Mortensen | 62/441 |
| 2,675,687 | 4/1954 | Philipp | 62/117.3 |
| 3,376,711 | 4/1968 | Hagendoorn et al. | 62/410 |
| 3,633,374 | 2/1970 | Canter | 62/156 |
| 3,834,779 | 9/1974 | Turner et al. | 312/214 |
| 3,868,152 | 2/1975 | Dixon | 312/214 |
| 3,939,666 | 2/1976 | Bashark | 62/150 |
| 4,191,434 | 3/1980 | Powell et al. | 312/214 |
| 4,330,310 | 5/1982 | Tate, Jr. et al. | 62/275 |
| 4,548,049 | 10/1985 | Rajgopal | 62/275 |
| 4,550,576 | 11/1985 | Tate et al. | 62/441 |
| 4,714,304 | 12/1987 | Sisk et al. | 312/214 |
| 4,732,432 | 3/1988 | Keil et al. | 312/214 |
| 4,831,780 | 5/1989 | Bockwinkel | 49/504 |
| 4,852,303 | 8/1989 | Rolek | 49/504 |
| 4,862,701 | 9/1989 | Small et al. | 62/150 |
| 4,884,415 | 12/1989 | Mandel et al. | 62/277 |
| 4,941,289 | 7/1990 | Rolek | 49/504 |

*Primary Examiner*—Henry A. Bennet
*Assistant Examiner*—William C. Doerrler
*Attorney, Agent, or Firm*—Bacon & Thomas

[57] ABSTRACT

A mullion bar assembly having enhanced heat transfer barrier characteristics is disclosed wherein the liners defining the freezer and the fresh food compartments define non-magnetic gasket sealing surfaces against which the magnetic door gaskets seal. Since the liners are typically made of plastic material, permanent magnets are disposed behind the liners so as to attract the magnetic gasket seals into sealing contact with their respective non-magnetic sealing surfaces. The non-magnetic sealing surfaces are spaced apart and the mullion bar is located between them such that it extends between opposite sides of the refrigerator cabinet and only between the spaced apart, non-magnetic sealing surfaces. No part of the mullion bar is exposed to either the freezer compartment or the fresh food compartment. Since the mullion bar extends only between the spaced apart sealing surfaces, the door gaskets prevent any exposure of the mullion bar to the compartment interiors, thereby preventing any direct heat transfer between the ambient atmosphere and the respective compartments via the mullion bar.

12 Claims, 5 Drawing Sheets

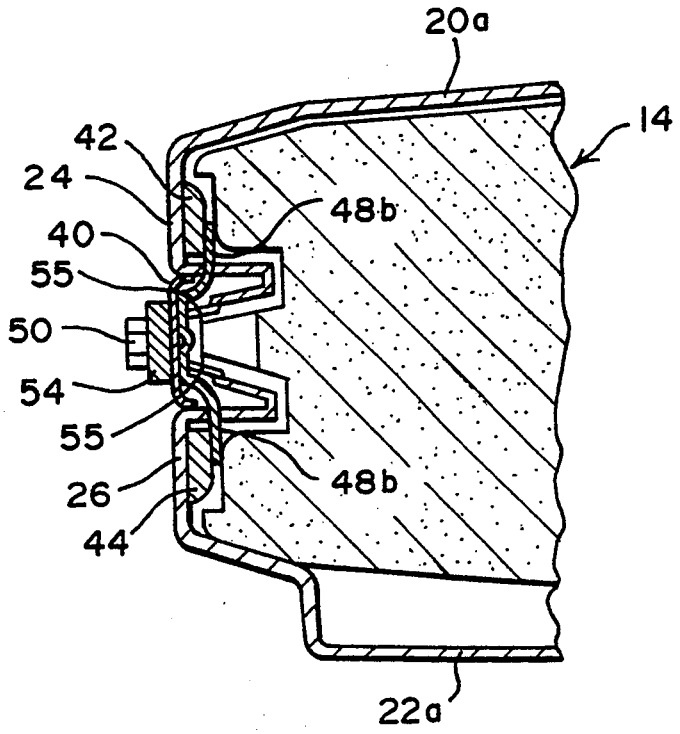
FIG. 5
FIG. 6
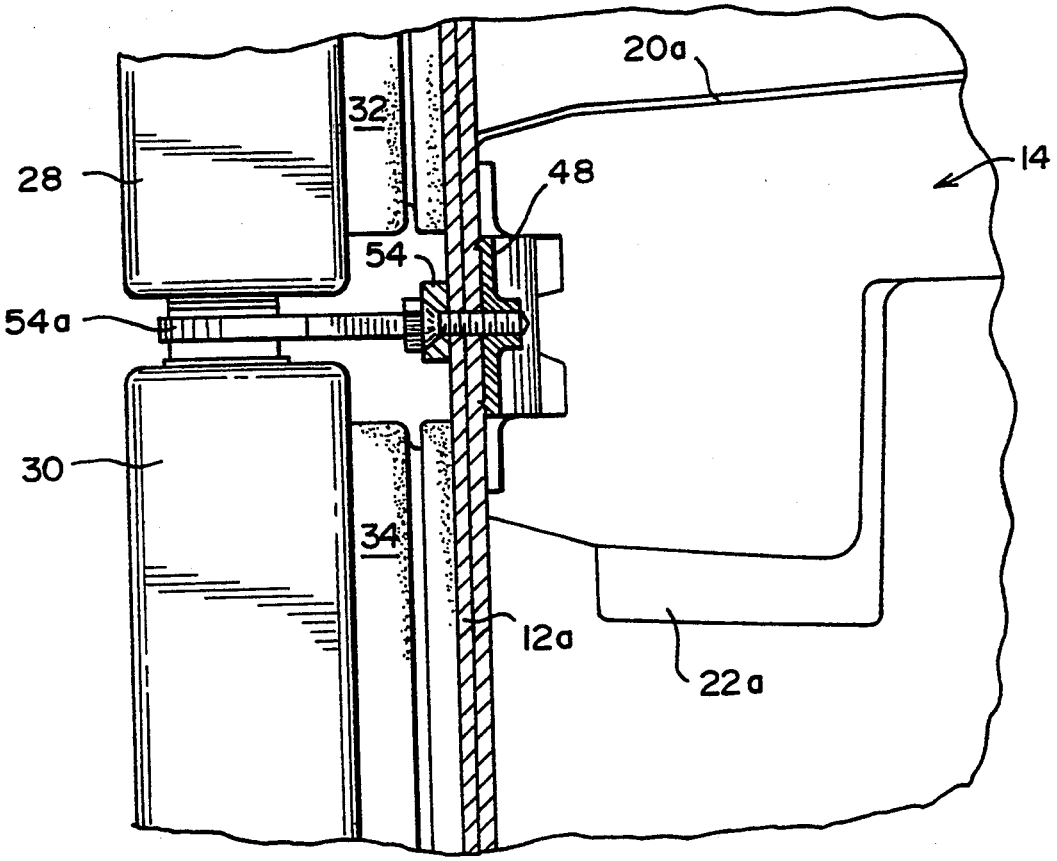

MULLION BAR ASSEMBLY WITH ENHANCED HEAT TRANSFER BARRIER CHARACTERISTICS

BACKGROUND OF THE INVENTION

The present invention relates generally to refrigerated cabinets, more particularly to a mullion bar assembly having enhanced heat transfer barrier characteristics to reduce the energy consumption of the refrigerated cabinet.

Conventional refrigerators typically have insulated freezer and fresh food compartments which are disposed in either a side-by-side, or top mount configuration. In the construction of such a refrigerator cabinet, an insulated interior wall is utilized to separate the interior space of the cabinet into the freezer and the fresh food compartments. Integrally molded plastic liners may be used to line the respective compartments. An insulation material is typically disposed between the compartment liners and the metal outer shell of the refrigerator cabinet.

A mullion bar assembly may be affixed to the front face of the interior separating wall. The mullion bar assembly typically includes a metallic mullion bar which extends over a substantial area of the front face of the interior wall.

It is well known in the art to utilize magnetic gasket seals around the edges of the doors of the refrigerator cabinet. Since the mullion bar is typically made of a metallic material and is also exposed to the ambient atmosphere, it has proven very convenient to extend the width of the mullion bar to a substantial portion of the width of the front face of the interior wall and to allow the magnetic gaskets to seal against the mullion bar. However, to do so inevitably exposes at least a portion of the metallic mullion bar to the interior of either the freezer or the fresh food compartments. Since the mullion bar is a metallic material, such exposure provides a pathway for the heat transfer from the ambient atmosphere into either the freezer or the fresh food compartment. When such ambient atmosphere is humid, condensation will appear on the face of mullion bar. It is well known in the art to provide an electrical heater behind the mullion bar which, when turned on, raises the temperature of the mullion bar to eliminate this condensation. However, since a portion of the mullion bar is exposed to the freezer and the fresh food compartments, raising the temperature of the mullion bar inherently raises the temperatures in these compartments.

Due to the exposure of the mullion bar to the freezer and the fresh food compartments, the energy requirement for the mullion bar heater is also increased since, in order to remove the condensation, the heater must raise the temperature of the mullion bar (which has been cooled via exposure to the freezer and fresh food compartments) a substantial amount. Since the freezer compartment is typically maintained at a temperature of 0° F. and the fresh food compartment is maintained at a temperature of approximately 38° F., it is apparent that the undesirable heat transfer via the mullion bar imposes an additional load on the central refrigeration system, as well as the mullion bar heating system.

SUMMARY OF THE INVENTION

A mullion bar assembly having enhanced heat transfer barrier characteristics is disclosed wherein the liners defining the freezer and the fresh food compartments define non-magnetic gasket sealing surfaces against which the magnetic door gaskets seal. Since the liners are typically made of plastic material, permanent magnets are disposed behind the liners so as to attract the magnetic gasket seals into sealing contact with their respective non-magnetic sealing surfaces.

The non-magnetic sealing surfaces are spaced apart and the mullion bar is located between them such that it extends between opposite sides of the refrigerator cabinet and only between the spaced apart, non-magnetic sealing surfaces. No part of the mullion bar is exposed to either the freezer compartment or the fresh food compartment. Since the mullion bar extends only between the spaced apart sealing surfaces, the door gaskets prevent any exposure of the mullion bar to the compartment interiors, thereby preventing any direct heat transfer between the ambient atmosphere and the respective compartments via the mullion bar.

A mullion bar heater may be located behind the mullion bar to heat the bar and remove condensation. However, the heating requirements of such a heater are reduced since the mullion bar is not exposed to the low temperatures in either the fresh food or the freezer compartments.

Brackets attaching opposite ends of the mullion bar to the refrigerator cabinet frame may also have tabs which serve to position the non-magnetic sealing surfaces of the freezer and fresh food compartment liners. One of the attaching brackets may also have a hinge pin which pivotally supports the refrigerator doors.

BRIEF DESCRIPTION OF THE DRAWINGS

FIG. 5 is a partial, cross-sectional view taken along line V—V in FIG. 4.

FIG. 6 is a partial, cross-sectional view taken along line VI—VI in FIG.

DETAILED DESCRIPTION OF THE PREFERRED EMBODIMENT

Figure 1:
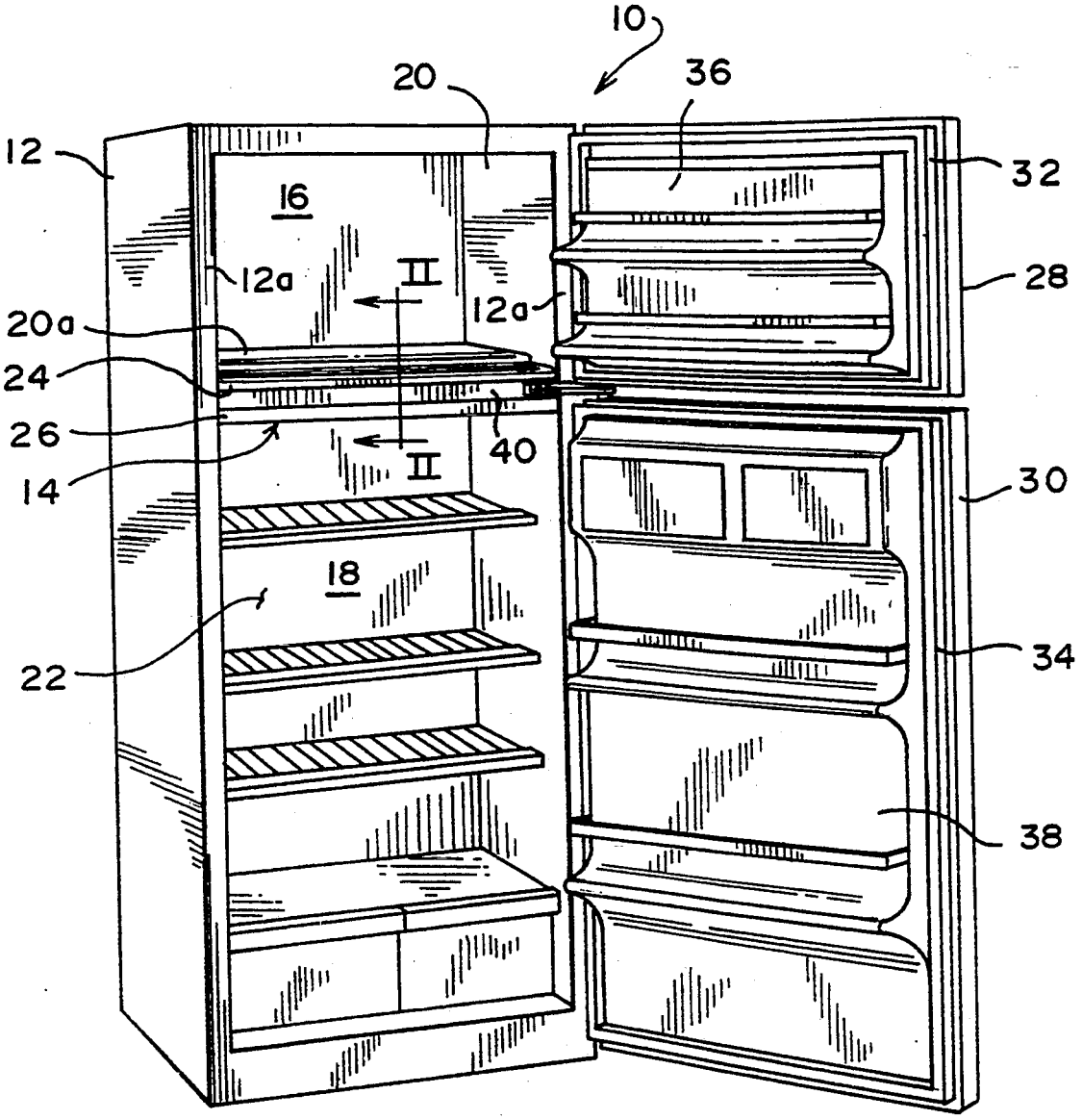
FIG. 1 is a perspective view of a refrigerator cabinet incorporating the mullion bar assembly according to the present invention.

A top mount refrigerator cabinet 10 incorporating the mullion bar assembly according to the present invention is illustrated in FIG. 1. Although the invention will be described in conjunction with a top mount refrigerator cabinet, it is to be understood that the principals disclosed herein are equally applicable to side-by-side type refrigerator cabinets.

The refrigerator 10 comprises an exterior cabinet 12, typically formed of sheet metal, with an interior wall 14 dividing the interior cabinet space into a freezer compartment 16 and a fresh food compartment 18. Freezer compartment liner 20 and fresh food compartment liner 22 define the interior surfaces of the respective compartments and are typically integrally molded from a plastic material. These liners define a back portion, opposite side portions, as well as top and bottom portions and are affixed, by known means, within the exterior cabinet 12. Insulating material (not shown) is disposed between the liners 20 and 22, and the exterior cabinet 12 in known fashion to provide the requisite insulation characteristics for the refrigerator cabinet 10. Interior dividing wall 14 also has insulation between the bottom 20*a* of the freezer liner 20 and the top 22*a* of the fresh food compartment liner 22. The front edge of the bottom 20*a* of the freezer compartment liner 20 defines a forwardly facing sealing surface 24. Similarly, the upper portion of the fresh food compartment liner 22 forms a sealing surface 26 which also faces forwardly and which is spaced apart from the sealing surface 24. Since liners 20 and 22 are formed of a plastic material, sealing surfaces 24 and 26 are non-magnetic sealing surfaces, Doors 28 and 30 are attached to the refrigerator cabinet 10 in known fashion to selectively close the freezer compartment 16 and the fresh food compartment 18, respectively. Magnetic gasket seals 32 and 34 may be attached to doors 28 and 30, respectively, such that, when the doors are closed, the magnetic gasket seals 32 and 34 seal against the front surfaces of the refrigerator cabinet 12, including sealing surfaces 24 and 26. In known fashion, molded plastic inserts 36 and 38 may be affixed to doors 28 and 30, respectively, to provide storage space in the doors.

Mullion bar 40 extends between opposite sides of the refrigerator cabinet 12 and is located such that it extends between the spaced apart, non-magnetic sealing surfaces 24 and 26. This is clearly illustrated in FIG. 2, which is a partial, cross-sectional view taken along line II—II in FIG. 1 illustrating the doors 28 and 30 in their closed positions. As can be seen, door gasket seal 32 will contact nonmagnetic sealing surface 24 and door gasket seal 34 will contact non-magnetic sealing surface 26. In order to urge the gaskets 32 and 34 into sealing contact with the non-magnetic sealing surfaces, magnets 42 and 44 may be located adjacent to surfaces formed on bottom portion 20*a* and top portion 22*a* which face away from the respective sealing surfaces 24 and 26. Magnets 42 and 44, which may be permanent magnets, are adhesively bonded to the opposite faces of sealing surfaces 24 and 26. The locations of magnets 42 and 44 attract magnets 32 and 34 when doors 28 and 30 are closed, thereby ensuring that the gaskets seal against the respective sealing surfaces 24 and 26. Quite obviously, other means for attaching magnets 42 and 44 to the opposite faces of sealing surfaces 24 and 26 may be utilized without exceeding the scope of the invention.

Figure 2:
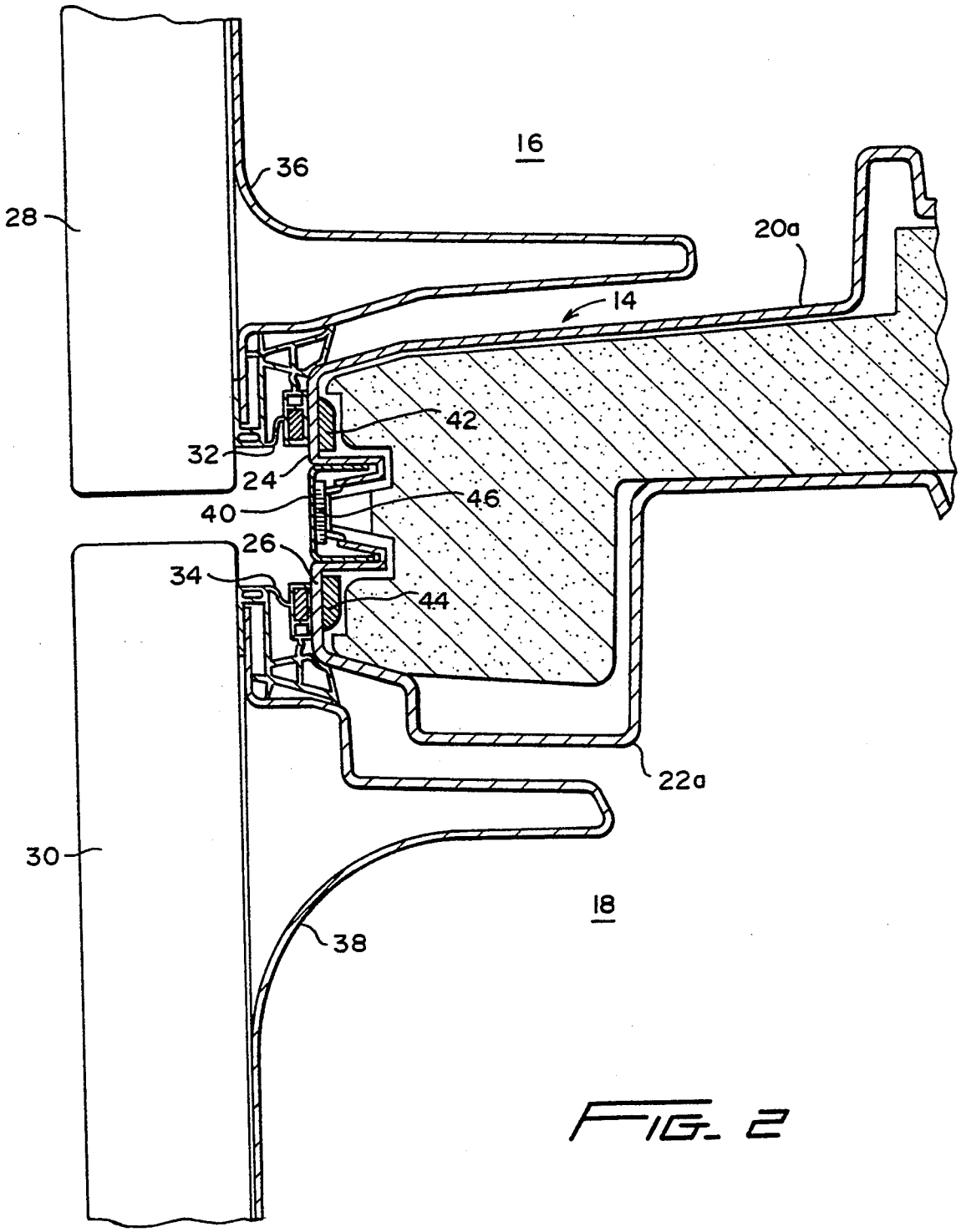
FIG. 2 is a partial, cross-sectional view taken along line II—II in FIG. 1 illustrating the doors in their closed positions.
Figure 4:
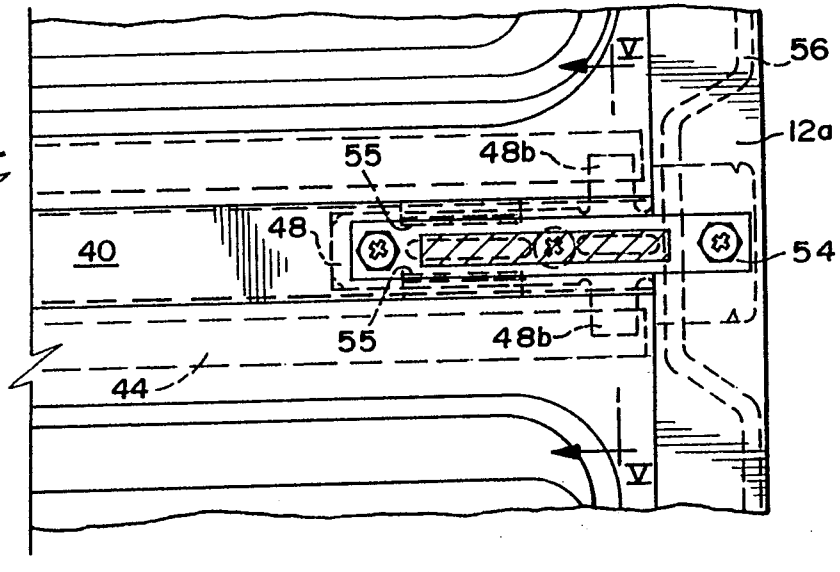
FIG. 4 is a partial, front view taken along line IV—IV in FIG. 3.
Figure 4:
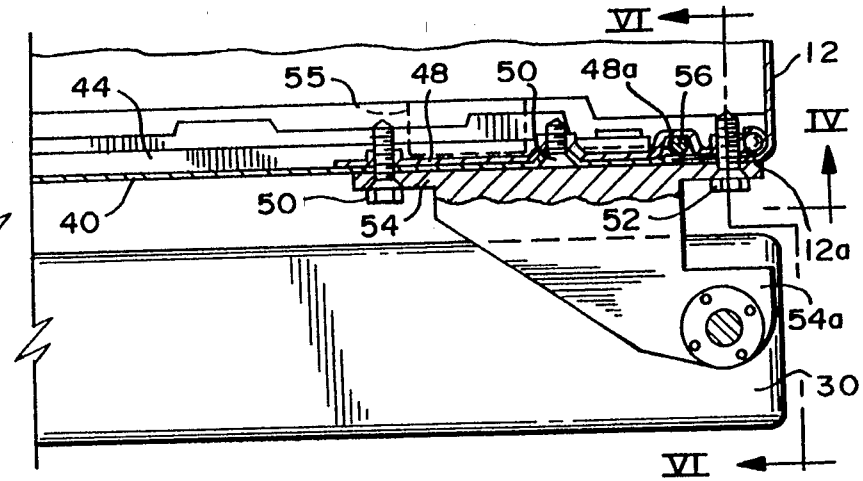
Figure 4:
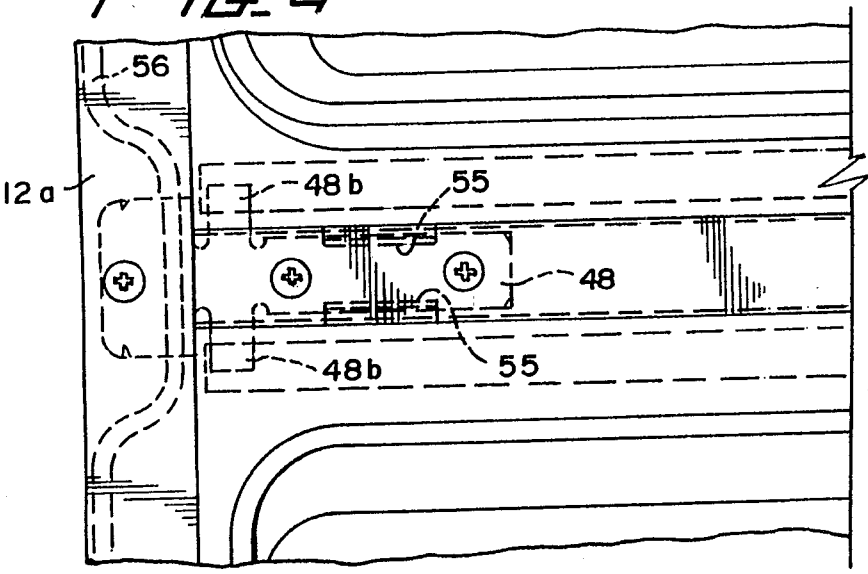

As is quite evident from FIG. 2, mullion bar 40 has a generally "U" shaped cross section and is retained between the spaced apart, non-magnetic sealing surfaces 24 and 26. Since mullion bar 40 extends only between these sealing surfaces, no part of the mullion bar is exposed to either the freezer compartment 16, or the fresh food compartment 18 when the doors 28 and 30 are closed. The present invention completely avoids any possible exposure of the mullion bar 40 to either of the low-temperature compartments by placing it completely outside the interface of the gasket seals and the sealing surfaces, which are formed of a nonmagnetic material having a relatively low heat transfer coefficient. This positively prevents any exposure of the metallic mullion bar 40 to either of the low-temperature compartments. The fact that magnetic seals 32 and 34 seal against a surface which has a relatively low heat transfer coefficient, and not against the mullion bar 40, positively prevents exposure of the mullion bar 40 to either of the compartments 16 or 18.

Mullion bar heater 46 may be attached to a rear surface of the mullion bar 40 to heat the mullion bar when it is desired to remove condensation from the opposite face of the mullion bar, which is exposed to ambient atmosphere. Such mullion bar heaters are well known in the art, as are their control systems. Any such known mullion bar heater may be utilized with the present invention. However, since the mullion bar 40 is not exposed to either of the low-temperature compartments of the refrigerator, the energy consumed by the mullion bar heater 46 will be reduced from the prior art devices since the temperature of the mullion bar 40 will not be directly influenced by the temperatures of either of the freezer or fresh food compartments.

Figure 3:
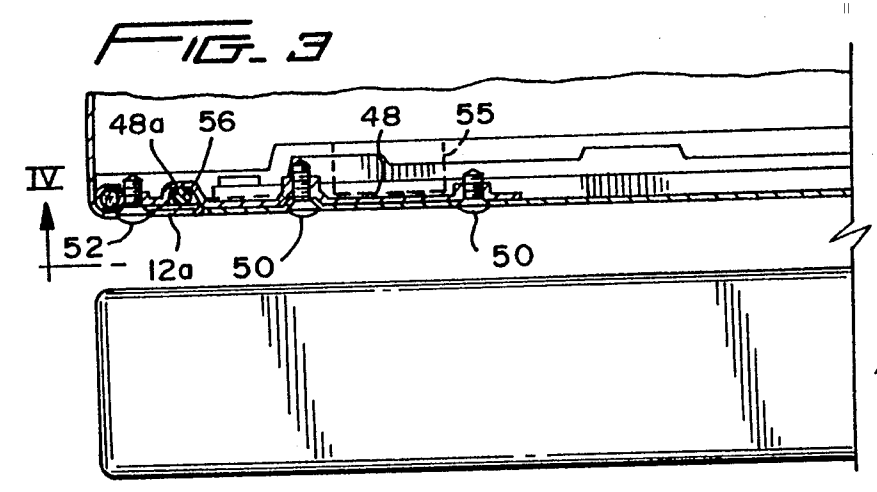
FIG. 3 is a partial top view, partially broken away, of the refrigerator cabinet in FIG. 1.
Figure 7:
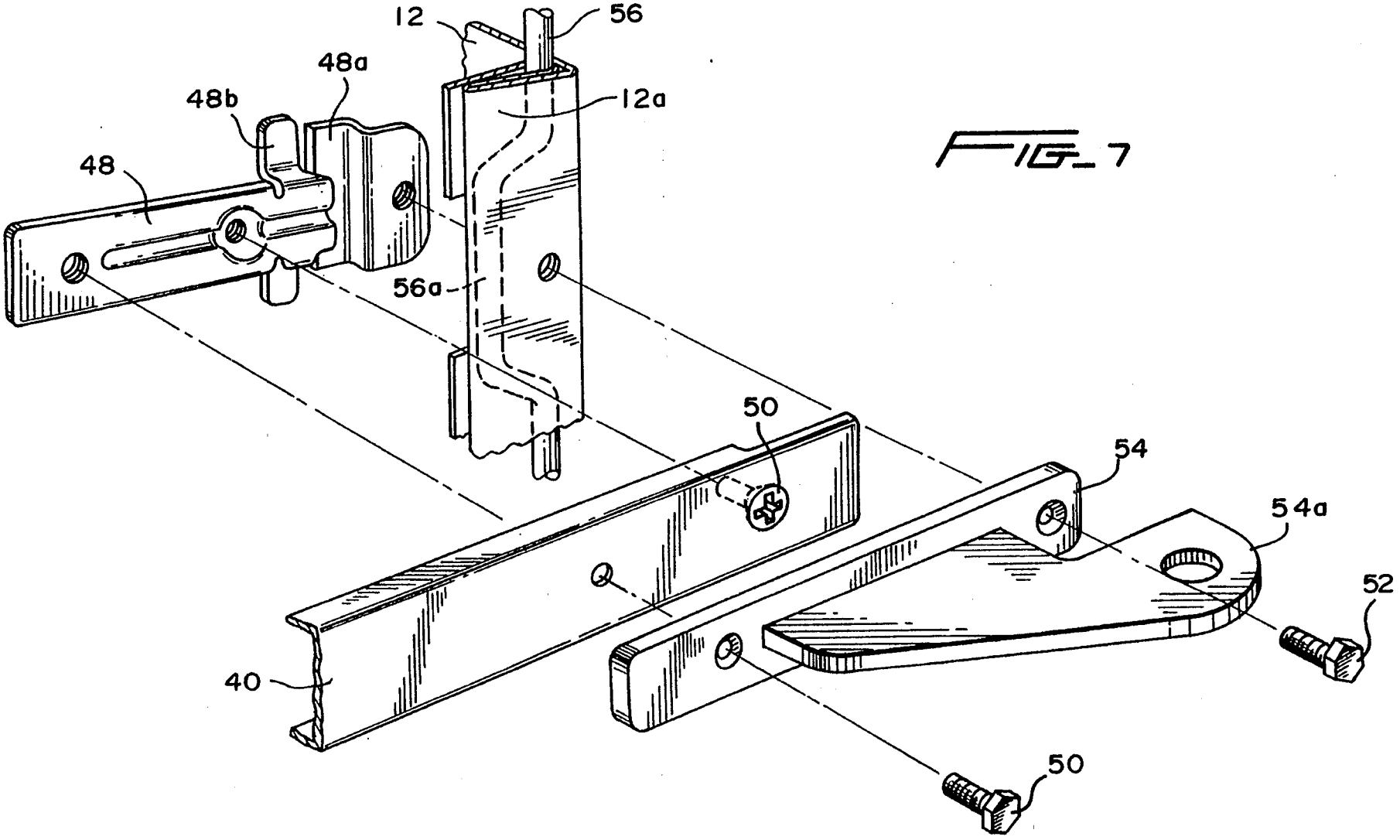
FIG. 7 is a partial, exploded perspective view showing the mullion bar attachment according to the present invention.

The attachment of mullion bar 40 to the refrigerator cabinet 12 is best illustrated in FIGS. 3 and 7. As can be seen, the front face of the exterior cabinet 12 has inturned flanges 12*a*. Mullion bar 40 extends between opposite sides of the refrigerator cabinet 12 and is attached thereto via brackets 48. Brackets 48 are attached to opposite ends of the mullion bar 40 via screws 50 and the ends of the brackets 48 are attached to opposite flanges 12*a* via screws 52. As can be seen in FIG. 3, the opposite edges of the mullion bar 40 bear against the innermost edges of the flanges 12*a* to improve the rigidity of the cabinet 12.

Door hinge pivot support 54 may also be attached to the mullion bar 40, the bracket 48 and the flange 12*a* via screws 50 and 52, as illustrated in FIGS. 3 and 7. The door hinge pivot support bracket 54 has pivot support portion 54*a* extending therefrom with pivot pins extending from opposite sides thereof to pivotally support the bottom portion of door 28 and the top portion of door 30. Other known hinge means are utilized to pivotally attach the doors 28 and 30 to the exterior cabinet 12.

As also illustrated in FIG. 7, the refrigerator cabinet cooling circuit may include a Yoder tube 56 extending around the periphery of the front face of the exterior cabinet 12. The Yoder tube 56 is formed with indented, generally "U"-shaped portions 56*a* adjacent to where the ends of the brackets 48 are attached to the exterior cabinet 12 to enable the screws 52 to be inserted through the flanges 12*a*. Brackets 48 may be formed with indentations 48*a* to enable the Yoder tube 56*a* to pass between the interior surface of flange 12*a* and the bracket 48.

Brackets 48 also have tabs 48*b* extending from opposite sides thereof, which tabs are displaced away from the main body of bracket 48. Tabs 48*b* are used to position the bottom portion 20*a* and the top portion 22*a* such that sealing surfaces 24 and 26 are substantially coplanar with the turned-in flanges 12*a* of the front face of the exterior cabinet 12. Quite obviously, other means for positioning sealing surfaces 24 and 26 may be utilized without exceeding the scope of this invention.

An additional pair of tabs 55 extend forward from the bottom of freezer liner 20*a* near each outer end thereof and from the top of fresh food liner 22*a* near each outer end thereof to engage the rear upper and lower surfaces of brackets 48 to thereby limit the outward travel of liners 20*a* and 22*a*, further assuring positioning of surfaces 24 and 26 coplanar with the turned-in flanges 12*a*.

Preferably, the front face of mullion bar 40 is substantially coplanar with the sealing surfaces 24 and 26, as best illustrated in FIG. 2. Quite obviously, however, other configurations of mullion bar and sealing surfaces may be utilized without exceeding the scope of this invention.

The foregoing description is provided for illustrative purposes only and should not be construed as in way limiting this invention, the scope of which is defined solely by the appended claims.

I claim:

1. A mullion bar assembly having enhanced heat transfer barrier characteristics for a refrigerator cabinet having a cabinet with opposite sides defining an interior space, interior wall means to divide the interior space into at least two chambers and movable door means to selectively open or close each of the at least two chambers, comprising:

a) first and second non-magnetic means operatively associated with the interior wall means and defining first and second, spaced apart non-magnetic sealing surfaces;

b) magnetic gasket sealing means located on the movable door means such that, when the door means close the at least two chambers, the magnetic gasket sealing means contact the first and second, spaced apart non-magnetic sealing surfaces;

c) spaced apart magnets located on the first and second non-magnetic means so as to attract the magnetic gasket sealing means and urge the gasket sealing means into sealing contact with the non-magnetic sealing surfaces; and, d) a mullion bar spaced from the magnets and extending between opposite sides of the refrigerator cabinet, the mullion bar located so as to extend between the first and second spaced apart non-magnetic sealing surfaces and out of contact with the magnetic gasket sealing means such that the mullion bar is out of direct heat transfer relationship with the at least two chambers when the door means are closed.

2. The mullion bar assembly of claim 1 wherein the mullion bar has opposite ends and further comprising bracket means to attach the opposite ends to the opposite sides of the refrigerator cabinet.

3. The mullion bar assembly of claim 2 wherein at least one of the bracket means further comprises pivot means to pivotally support the door means thereon.

4. The mullion bar assembly of claim 1 wherein the mullion bar defines an outer face substantially co-planar with the first and second, spaced apart, non-magnetic sealing surfaces.

5. The mullion bar assembly of claim 1 further comprising heater means operatively associated with the mullion bar.

6. The mullion bar assembly of claim 1 wherein the first non-magnetic means comprises a first plastic liner lining the interior of one of the at least two chambers.

7. The mullion bar assembly of claim 6 wherein the second non-magnetic means comprises a second plastic liner lining the interior of the other of the at least two chambers.

8. The mullion bar assembly of claim 7 wherein the first and second plastic liners each define a surface facing opposite to the first and second sealing surfaces and wherein the spaced apart magnets comprise:

a) a first magnet located adjacent to the surface facing opposite from the first sealing surface; and, b) a second magnet located adjacent to the surface facing opposite from the second sealing surface.

9. The mullion bar assembly of claim 8 wherein the first and second magnets each comprise permanent magnets.

10. The mullion bar assembly of claim 8 wherein the mullion bar has opposite ends and further comprising bracket means to attach the opposite ends to the opposite sides of the refrigerator cabinet.

11. The mullion bar assembly of claim 10 further comprising first tab means extending from the bracket means and adapted to contact a portion of the first and second plastic liners so as to locate the first and second non-magnetic sealing surfaces.

12. The mullion bar of claim 11 further comprising second tab means extending from the first and second plastic liners and located so as to contact the bracket means thereby positioning the first and second non-magnetic sealing surfaces.

* * * * *